US011857094B2

(12) United States Patent
Hubbard et al.

(10) Patent No.: US 11,857,094 B2
(45) Date of Patent: Jan. 2, 2024

(54) FLAVOR DISPENSING DRINKING STRAW

(71) Applicants: Daniel Hubbard, Virginia Beach, VA (US); Mary Hubbard, Virginia Beach, VA (US)

(72) Inventors: Daniel Hubbard, Virginia Beach, VA (US); Mary Hubbard, Virginia Beach, VA (US)

( * ) Notice: Subject to any disclaimer, the term of this patent is extended or adjusted under 35 U.S.C. 154(b) by 121 days.

(21) Appl. No.: 17/520,848

(22) Filed: Nov. 8, 2021

(65) Prior Publication Data

US 2022/0175164 A1 Jun. 9, 2022

Related U.S. Application Data

(60) Provisional application No. 63/122,124, filed on Dec. 7, 2020.

(51) Int. Cl.
*A47G 21/18* (2006.01)
*A47G 19/30* (2006.01)

(52) U.S. Cl.
CPC ..... *A47G 21/183* (2013.01); *A47G 21/18* (2013.01); *A47G 21/182* (2013.01); *A47G 21/184* (2013.01); *A47G 21/186* (2013.01)

(58) Field of Classification Search
CPC .... A47G 21/18; A47G 21/182; A47G 21/183; A47G 21/164; A47G 21/186
USPC ..... 239/33
See application file for complete search history.

(56) References Cited

U.S. PATENT DOCUMENTS 3,463,361 A * 8/1969 Cook ..... A47G 21/183 222/630
3,606,156 A * 9/1971 Homorodean et al. ..... A47G 21/182 239/33
4,091,632 A * 5/1978 Marchewka ..... A47G 21/187 62/530
4,134,494 A * 1/1979 Wong ..... A47G 21/187 215/388
4,792,333 A * 12/1988 Kidder ..... A61J 7/0038 604/83
4,921,713 A * 5/1990 Fowler ..... A47G 21/183 426/96
4,951,839 A * 8/1990 Kong ..... G01F 11/268 222/454
9,017,749 B2 * 4/2015 Ayeni ..... A47G 21/183 426/433

(Continued)

*Primary Examiner* — Chee-Chong Lee
(74) *Attorney, Agent, or Firm* — Brennan, Manna & Diamond, LLC

(57) ABSTRACT

This present invention relates to a flavor dispensing drinking straw device designed to retain and dispense an appropriate amount of flavoring, syrup and/or medicine into a beverage as per the desires of the users. The device comprises a topper having an internal cavity that holds a predefined amount of flavoring, syrup and/or medicine that the user can dispense through a spiral straw by simply and gently squeezing the topper, wherein the user can then consume the flavored or medicated beverage through a second tubular straw in a traditional manner. The uniquely designed straw device is both environmentally safe and reusable. Additionally, the topper can be refilled with the flavor, once the stored flavor is exhausted. The flavor infusing straw offers a more enjoyable and delicious drinking experience, and can be used with a variety of beverage containers.

19 Claims, 5 Drawing Sheets

(56) References Cited

U.S. PATENT DOCUMENTS

2008/0308584 A1* 12/2008 Blondeel ..... B65D 1/09
222/541.9

* cited by examiner

FLAVOR DISPENSING DRINKING STRAW

CROSS-REFERENCE TO RELATED APPLICATION

The present application claims priority to, and the benefit of, U.S. Provisional Application No. 63/122,124, which was filed on Dec. 7, 2020 and is incorporated herein by reference in its entirety.

FIELD OF THE INVENTION

The present invention relates generally to the field of drinking straw for use with drinking fluids. More specifically, the present invention relates to a flavor splash straw that is environmentally safe and reusable. The uniquely designed straw features a topper that holds flavorings and syrups that can be dispensed into a drinking container with a squeeze by a user. The flavor dispensing straw enables the users to infuse water or other beverages with a chosen flavor as desired. The topper can be refilled with different flavors as per the preferences of the user, and the straw is reusable and can be used with a variety of drinking containers such as bottles, cups, mugs and more. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, many individuals use straws for drinking or consuming fluids, such as water, juices, cocktails and other beverages. Various kinds of drinking straws are available in the market for use by consumers when drinking a beverage. For example, disposable plastic straws are widely used by individuals to consume fluids. However, plastic straws are not reusable, are non-biodegradable, and therefore are detrimental to the environment. In fact, the use of plastic straws by individuals worldwide results in millions of tons of plastic waste being generated each year.

Other alternate options for reusable and nonreusable straws are also available in the marketplace. For example, reusable and nonreusable straws, such as bamboo straws, steel straws, coconut leaf straws, etc., are readily available in the marketplace, and are both eco-friendly and safer for the environment. However, such straws are limited in their function to merely enabling an individual to consume a beverage without having his or her mouth touch the beverage container, and such straws serve no other purpose or function.

Additionally, many individuals prefer flavored beverages over plain water or other relatively tasteless beverages, and desire to add a flavor of their choice and potency or concentration to their beverage. In order to do so, individuals must typically transport various flavoring agents or syrups to add the same to a beverage and then mix the two together to achieve the desired flavored beverage. However, this requires the individual to have to buy, transport and store various flavoring syrups or other ingredients separately, and then physically add the same to the beverage to infuse the desired flavor. This process may be quite inconvenient, and requires the individual to guess at the appropriate amount of flavoring to add to the beverage or risk ruining the same (e.g., by adding too much of the flavored syrup or other flavored ingredient). Additionally, having to manually add the flavoring to the beverage may result in spillage and stains to the individual's clothes. Accordingly, many individuals may be reluctant to use such flavoring in their beverages and be forced to consume bland beverages.

Therefore, there exists a long felt need in the art for a reusable and flavor dispensing drinking straw that can be used to consume beverages, and that is both biodegradable and eco-friendly. Additionally, there is a long felt need in the art for a flavor dispensing drinking straw device that is multi-functional, and is not limited in purpose to being used to consume a beverage. More specifically, there is a long felt need in the art for a flavor dispensing drinking straw that can also be used to infuse a flavor into a beverage of the user's choice, and in an appropriate quantity. Additionally, there is a long felt need in the art for a flavor dispensing drinking straw that is both portable and aesthetically pleasing. Moreover, there is a long felt need in the art for a flavor dispensing straw that can be used with various different types of containers, such as cups, glasses, bottles and more. Finally, there is a long felt need in the art for a flavor dispensing drinking straw that is relatively inexpensive to manufacture and that is both safe and easy to use.

The subject matter disclosed and claimed herein, in one embodiment thereof, comprises a flavor dispensing drinking straw designed to hold and dispense various flavorings/syrups into a container of water or another beverage. The flavor dispensing drinking straw comprises a tubular silicon straw, a spiral silicon straw and a topper or other container having an interior cavity to store an appropriate quantity of a flavoring or a syrup and an exterior surface with volumetric gradations thereon. The spiral straw wraps around the tubular straw and is connected to, and in fluid communication with, the interior cavity of the topper. The tubular straw extends through the topper, but is not in fluid communication with the interior cavity. The quantity of flavoring or syrup may be added to the interior cavity via an opening located on top of the topper in fluid communication therewith, wherein the flavoring or syrup is stored until needed. When an individual desires to infuse his or her beverage with the flavoring or syrup, the individual will place both the tubular and spiral straws into the beverage of choice and gently squeeze the topper to force the flavoring or syrup through the spiral straw and into the beverage where it may be mixed by gentle agitation of the beverage container or stirring using the flavor dispensing drinking straw of the present invention.

In this manner, the novel flavor dispensing drinking straw of the present invention accomplishes all of the forgoing objectives, and provides a relatively easy, convenient and cost-effective solution for dispensing flavoring and syrups into the drinking container filled with the user's beverage of choice. The flavor dispensing drinking straw of the present invention is also user friendly, as it enables an individual to add the flavoring syrups easily with a simple squeeze, thereby requiring little effort and eliminating the guess work typically associated with calculating the appropriate amount of syrup to add, as well as the risk of spilling the syrup or otherwise staining the individual's hands or clothes.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a flavor dispensing drinking straw designed to hold and dispense various flavorings/syrups into a container of water or other beverage. The straw device comprises a tubular silicon straw, a spiral silicon straw, and a topper to hold the flavor or syrup until needed. The spiral straw wraps around the tubular straw but has an exterior diameter (i.e., measured between the outermost limits of the spiral) that is small enough to fit into a traditional water bottle opening. A proximal end of the spiral straw is connected to, and in fluid communication with, the bottom of the interior cavity of the topper. The tubular straw passes through the topper and the internal passageway of the spiral straw, but is not in fluid communication with the interior cavity of the topper. The interior cavity of the topper is filled with the flavoring or syrup via an opening positioned on top of the topper having a hinged lid or cap, and external gradations on the topper instruct the individual on how much flavoring/syrup should be added to the internal cavity.

The topper is comprised of a generally compressible material that, when gently squeezed by the user, causes the flavoring/syrup stored in the internal cavity of the topper to travel through the continuous opening in the spiral straw and into the beverage in which the flavor dispensing drinking straw has been inserted. The individual may then consume the flavored beverage through the continuous channel in the tubular straw in a typical fashion.

In a further embodiment of the present invention, a drinking straw to infuse flavor/syrup/diluted medicine into a container of water or other beverage is disclosed. The flavor dispensing drinking straw is comprised of an elongated tubular straw having a continuous channel therein, a spiral straw having a continuous opening therein and that is wrapped around the tubular straw, and a designer topper having an exterior surface with volumetric gradations thereon and an internal cavity to hold a predetermined quantity of a flavoring, syrup, diluted medicine or the like, wherein the designer topper is comprised of a dishwasher safe, food grade and compressible material. The spiral straw is connected to, and in fluid communication with, the bottom of the interior cavity of the topper, and acts as a conduit for the flavor/syrup/diluted medicine to mix with water or another beverage when the topper is gently squeezed by a user, and the tubular straw acts as a conduit for the flavored water or other beverage to be consumed by the user after mixing. The flavoring may be granular or liquid in form, or a combination thereof, and may be comprised of more than one flavoring, syrup, medicine or the like.

The flavor dispensing drinking straw of the present invention is environmentally safe and reusable. The flavor dispensing drinking straw is also dishwasher safe and enables a user to infuse his or her water or other beverage with a chosen flavor when desired, thereby providing a more enjoyable and delicious drinking experience. The invention offers straws and toppers for a variety of drinking containers, such as bottles, cups, mugs and more.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
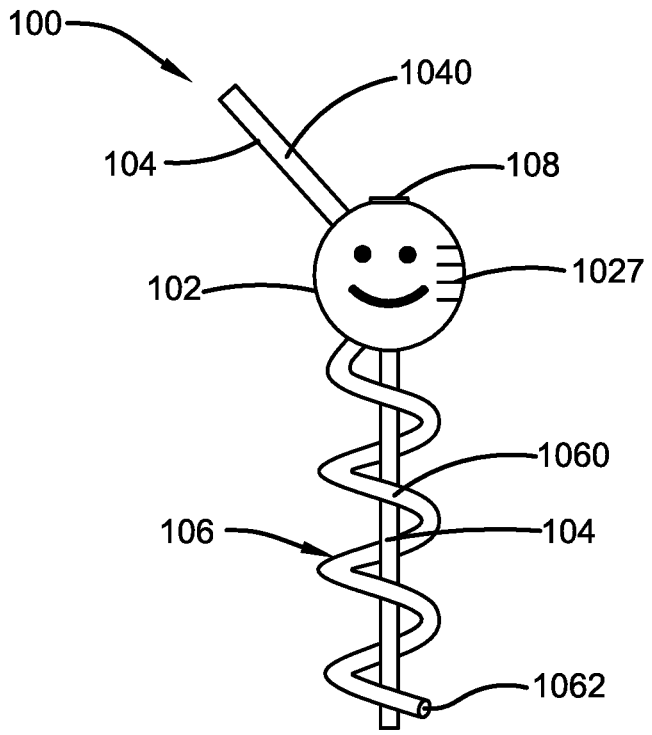
FIG. 1 illustrates a perspective view of one potential embodiment of the flavor dispensing drinking straw device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As stated above, there is a long felt need in the art for a reusable and flavor dispensing drinking straw that can be used to consume beverages, and that is both biodegradable and eco-friendly. Additionally, there is a long felt need in the art for a flavor dispensing drinking straw device that is multi-functional, and is not limited in purpose to only being used to consume a beverage. More specifically, there is a long felt need in the art for a flavor dispensing drinking straw that can also be used to infuse a flavor into a beverage of the user's choice, and in an appropriate quantity. Additionally, there is a long felt need in the art for a flavor dispensing drinking straw that is both portable and aesthetically pleasing. Moreover, there is a long felt need in the art for a flavor dispensing straw that can be used with various different types of containers, such as cups, glasses, bottles and more. Finally, there is a long felt need in the art for a flavor dispensing drinking straw that is relatively inexpensive to manufacture and that is both safe and easy to use.

Referring initially to the drawings, FIG. 1 illustrates a perspective view of one potential embodiment of the flavor dispensing drinking straw device 100 of the present invention in accordance with the disclosed architecture. The flavor dispensing drinking straw device 100 is preferably comprised of a topper 102, a tubular straw 104, a spiral straw 106 and a quantity of a flavoring or syrup 300. Unless otherwise stated herein, the various components of the flavor dispensing drinking straw 100 of the present invention are preferably comprised of reusable, dishwasher-safe, food grade plastic or silicone.

The spiral straw 106 wraps around the tubular straw 104, wherein the tubular straw 104 extends through a centralized passageway formed by the spiral straw 106. The topper 102 forms a repository and is filled with the flavorings and/or syrups 300. More specifically, the topper 102 has a flavor opening 1022 therein that extends to, and is in fluid communication with, an interior cavity 1023 for storing the flavorings and/or syrups 300 until needed. The flavor opening 1022 is covered with a hinged lid 108 when not in use to prevent spillage and/or contaminants from entering into the topper 102. The lid 108 can be opened to fill the topper 102 with the flavorings and/or syrups 300. The topper 102 is preferably comprised of a compressible material, wherein a user can gently compress the topper 102 when he or she desires to infuse his or her beverage with the flavorings and/or syrups 300 stored therein, as described more fully below. Additionally, the topper 102 comprises an exterior surface 1021 having a plurality of volumetric gradations 1027 thereon to instruct a user of how much flavorings and/or syrups 300 to add to the topper 102 and/or how much has been dispended from the topper 102 into the beverage of choice.

The tubular straw 104 is similar to a traditional straw and has a continuous opening or channel 1040 extending along its entire length. As best shown in FIG. 1, the tubular straw 104 extends through and beyond the topper 102 in at last two different directions. Nonetheless, the tubular straw 104 is not in fluid communication with the interior cavity 1023 or the flavoring/syrup 300 stored therein, and forms a seal at each of its entry and exit points with the topper 102 so that the device 100 is leak-proof. As explained more fully below, the user consumes the flavored beverage via the tubular straw 104 in the ordinary course of use.

The spiral straw 106 is shaped and designed to uniquely wrap around the tubular straw 104, and is also comprised of a central passageway 1060 formed by the various spirals and a continuous opening 1062 extending along its length. The spiral straw 106 is connected to, and in fluid communication with, the bottom of the interior cavity 1023 of the topper 102 via an egress or opening 1026 therein such that when the user gently compresses the topper 102 the flavoring/syrup 300 stored therein is pushed through the continuous opening 1062 and into the beverage of choice, as described more fully below. As previously stated, the topper 102 is preferably comprised of a food-grade, biodegradable, environmentally friendly and compressible silicon material. When the topper 102 is not squeezed or retains its normal configuration, the flavor/syrup 300 stored in the interior cavity 1023 of the topper 102 does not travel through the continuous opening 1062 in the spiral straw 106 and into the beverage container or glass.

Similarly, both the tubular straw 104 and the spiral straw 106 are preferably comprised of a silicone and are FDA and RoHs approved. Further, all the components of the flavor dispensing drinking straw device 100 are free from phthalate, lead, cadmium, mercury and PBBs. In one embodiment, a cleaning brush may be also commercially available along with the flavor dispensing drinking straw device 100 to properly clean the device 100 and, particularly, the continuous opening 1040 in the tubular straw 104 and the continuous opening 1062 in the spiral straw 106. The tubular straw 104 can be easily used to consume water, juices, smoothies, milkshakes or any other drink, and the spiral straw 106 can be used to easily add granular or liquid flavoring, syrups, medicines, etc. into a beverage. More specifically, the tubular straw 104 acts as conduit for the beverage placed in a tumbler or glass to be consumed, and the spiral straw 106 acts as a conduit or delivery system for the syrup or flavoring 300 stored in the interior cavity 1023 of the topper 102.

In one embodiment, the diameters of each of the tubular straw 104 and the spiral straw 106 are approximately same. However, in an alternate embodiment, the tubular straw 104 and the spiral straw 106 may have different diameters, for example, to allow for faster or slower infusion of the flavorings/syrup 300 through the spiral straw 106, or consumption of the flavored beverage via the tubular straw 104. The spiral straw 106 is designed such that the flavor or syrup 300 from the internal cavity 1023 of the topper 102 travels easily into a container, glass or bottle when squeezed by the user. Additionally, the overall outside diameter of the spiral straw 106 should be small enough so that it can be inserted into a standard consumer water bottle.

Figure 2:
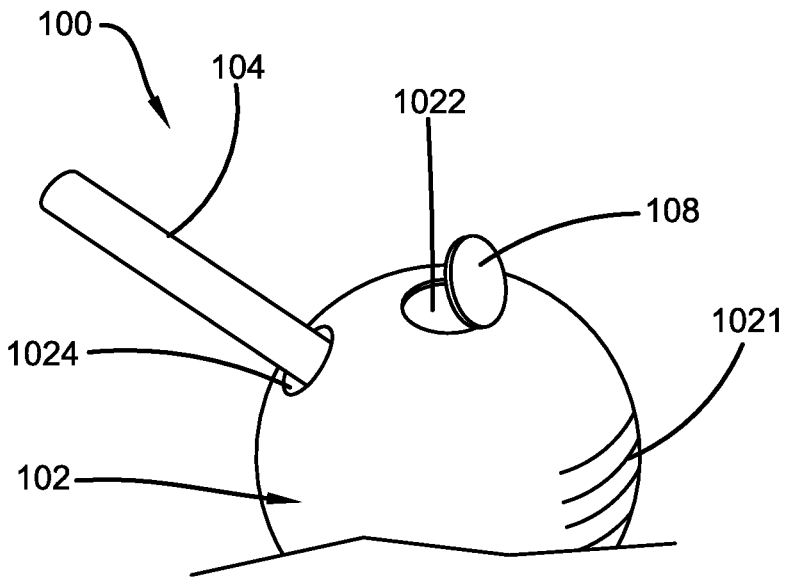
FIG. 2 illustrates a partial perspective view of one potential embodiment of the topper of the flavor dispensing drinking straw device of the present invention in accordance with the disclosed architecture.

FIG. 2 illustrates a partial perspective view of one potential embodiment of the topper 102 of the flavor dispensing drinking straw device 100 of the present invention in accordance with the disclosed architecture. As shown, at the top of the topper 102, a flavor filling hole 1022 is present which can be securely covered by a lid 108. To fill the interior cavity 1023 of the topper 102 with a flavoring or syrup 300, the hinged lid 108 may be opened. Once filled with an appropriate amount of flavoring or syrup 300 (i.e., which a user may determine by using the volumetric markings 1027 present on the exterior surface 1021 of the topper 102), the lid may be closed to prevent spillage or contamination from entering the internal cavity 1023.

Additionally, a tubular straw top hole 1024 allows the tubular straw 104 to be accessed by a user for consuming a beverage or water from a tumbler or glass. It should be noted that the filled flavor or syrup 300 can only be accessed by the spiral straw and not by the tubular straw 104. It should also be appreciated that the flavor filling hole 1022 and the tubular straw top hole 1024 can be located at any desired place along the top portion of the topper 102, and that the size of the openings 1022, 1024 are according to the size of the topper 102 and the diameter of the tubular straw 104.

Figure 3:
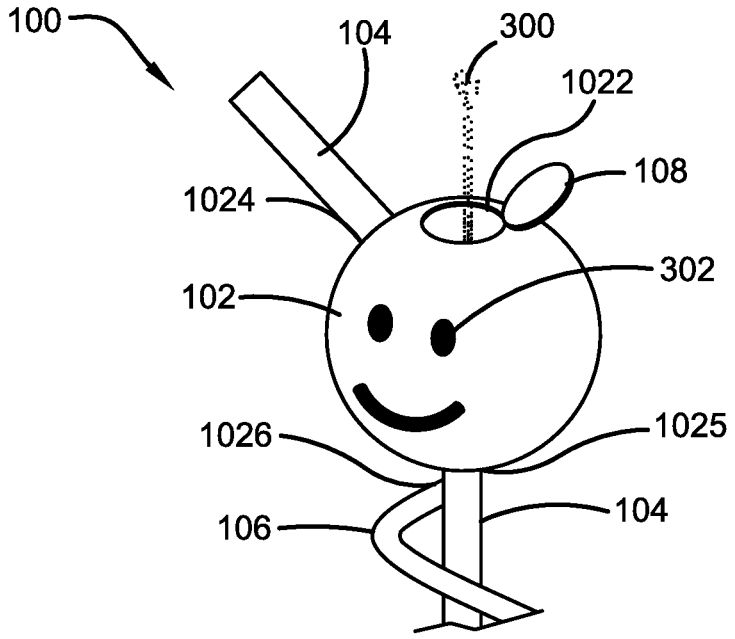
FIG. 3 illustrates a partial perspective view of one potential embodiment of the flavor dispensing drinking straw device of the present invention in accordance with the disclosed architecture, wherein a flavoring substance is being added to the topper.

FIG. 3 illustrates a partial perspective view of one potential embodiment of the flavor dispensing drinking straw device 100 of the present invention in accordance with the disclosed architecture, wherein a flavoring substance 300 is being added to the internal cavity 1023 of the topper 102. As stated earlier, the flavor filling hole 1022 is used for filling the internal cavity 1023 of the topper 102 with a flavoring or syrup 300 that can then be infused on demand into a beverage via the spiral straw 106. A liquid medicine can also be placed into the internal cavity 1023 of the topper 102 to allow a user to drink the medicine dissolved in water or any other beverage. The flavor filling hole 1022 is accessed by opening the lid 108.

In use, the flavoring or syrup 300 travels through the spiral straw 106 via the spiral straw opening 1026 when the topper 102 is gently squeezed by a user. The compressive forces push the syrup or flavoring 300 down into the tumbler or glass in which the flavor dispensing drinking straw device 100 is used. Further, the tubular straw 104 passes through the topper 102 via the holes 1024, 1025, but is not in fluid communication with the internal cavity 1023. More specifically, the tubular straw 104 is sealed within the topper 102, and cannot access the stored flavoring or syrup 300. The topper 102 may have any design, logo, trademark or embroidery 302 positioned along its exterior surface 1021, and the topper 102 and the straws 104, 106 may be available in multiple colors and sizes to satisfy the requirements of various users.

Figure 4:
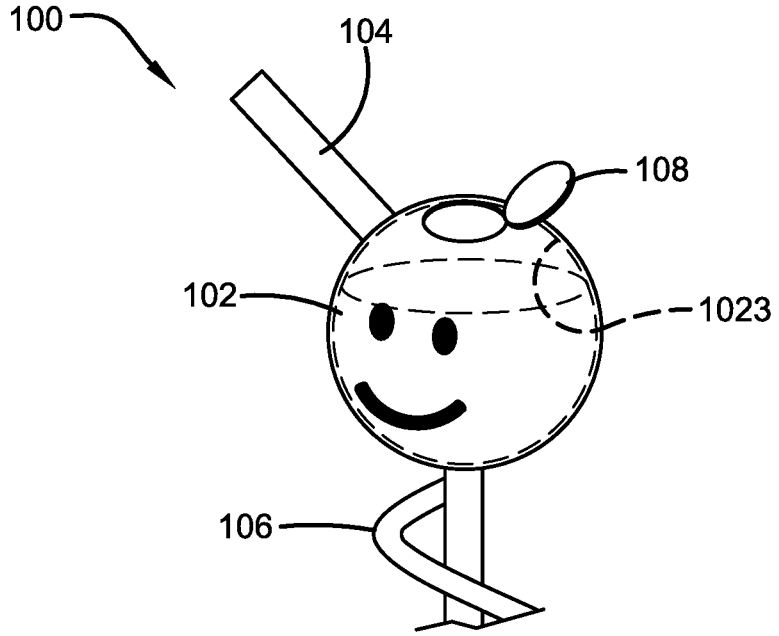
FIG. 4 illustrates a partial and transparent perspective view of one potential embodiment of the flavor dispensing drinking straw device of the present invention in accordance with the disclosed architecture, wherein a flavoring substance is contained within the topper and ready for use.

FIG. 4 illustrates a partial and transparent perspective view of one potential embodiment of the flavor dispensing drinking straw device 100 of the present invention in accordance with the disclosed architecture, wherein a flavoring substance 300 is contained within the internal cavity 1023 of the topper 102 and ready for use. As shown, the flavor/syrup/diluted medicine 300 is stored in the interior cavity 1023 of the topper 102. After filling of the cavity 1023 with the flavor/syrup/diluted medicine 300, the lid 108 at the top of the topper 102 is closed. To mix the flavor/syrup/diluted medicine 300 with water or a beverage in a container or glass, the topper 102 is squeezed and thus forces the flavor/syrup/diluted medicine 300 to travel through the spiral straw 106 into the beverage of choice. Once mixed, the flavored beverage or water may be consumed through the tubular straw 104 in a manner similar to that of a conventional straw.

However, the design of the spiral straw 106 is such that the flavor/syrup/diluted medicine 300 will not travel through the spiral straw 106 when the topper 102 is not squeezed. More specifically, the spiral straw 106 acts as a conduit from the topper 102 to carry flavor/syrup/diluted medicine 300 to the bottle/glass/tumbler.

Figure 5:
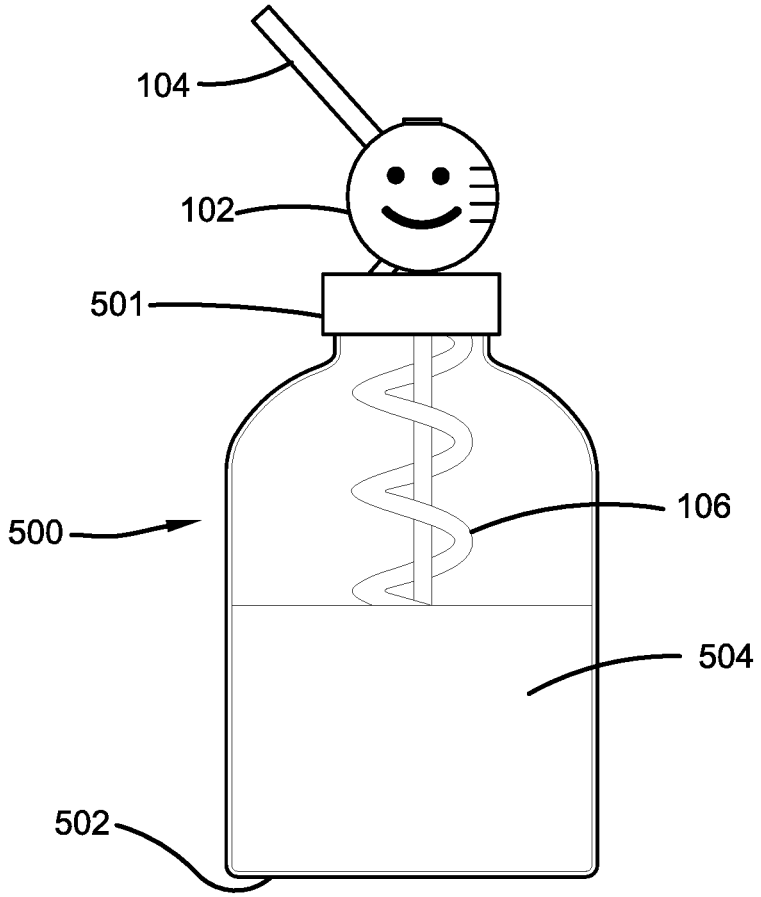
FIG. 5 illustrates a perspective view of one potential embodiment of the flavor dispensing drinking straw device of the present invention in accordance with the disclosed architecture, wherein the device is removably attached to a beverage container and has been used to flavor the beverage contained therein.

FIG. 5 illustrates a perspective view of one potential embodiment of the flavor dispensing drinking straw device 100 of the present invention in accordance with the disclosed architecture, wherein the device 100 is removably attached to a beverage container 500 and has been used to flavor the beverage contained therein. As shown, the bottle or beverage container 500 is comprised a lid 501 and a base or body portion 502. The tubular straw 104 and the spiral straw 106 may pass through an opening in the lid 501 or may be used without the lid 501, and the length of both the straws 104, 106 is such that the straws 104, 106 touch the bottom of the base 502 of the bottle 500. In use, when the topper 102 is gently squeezed by a user, the flavor/syrup/diluted medicine 300 stored within the interior cavity 1023 of the topper 102 travels through the spiral straw 106 to mix with the water or any other beverage present in the bottle 500. Thereafter, the flavored beverage or water 504 may be consumed through the tubular straw 104 by the user.

In the present embodiment, the lid 501 may have an opening through which the tubular straw 104 and the wrapped spiral straw 106 may be inserted into the bottle 500. In a preferred embodiment of the present invention, the straws 104, 106 of the present embodiment are approximately 9" in length, and have an outer diameter of between 7 mm and 9 mm, said sizes being generally compatible with 20 oz, 30 oz and 40 oz tumblers and bottles. Notwithstanding, the device 100 of the present invention is not so limited and many other lengths and diameters may also be used to satisfy user need and/or preference or to suit a particular application.

Figure 6:
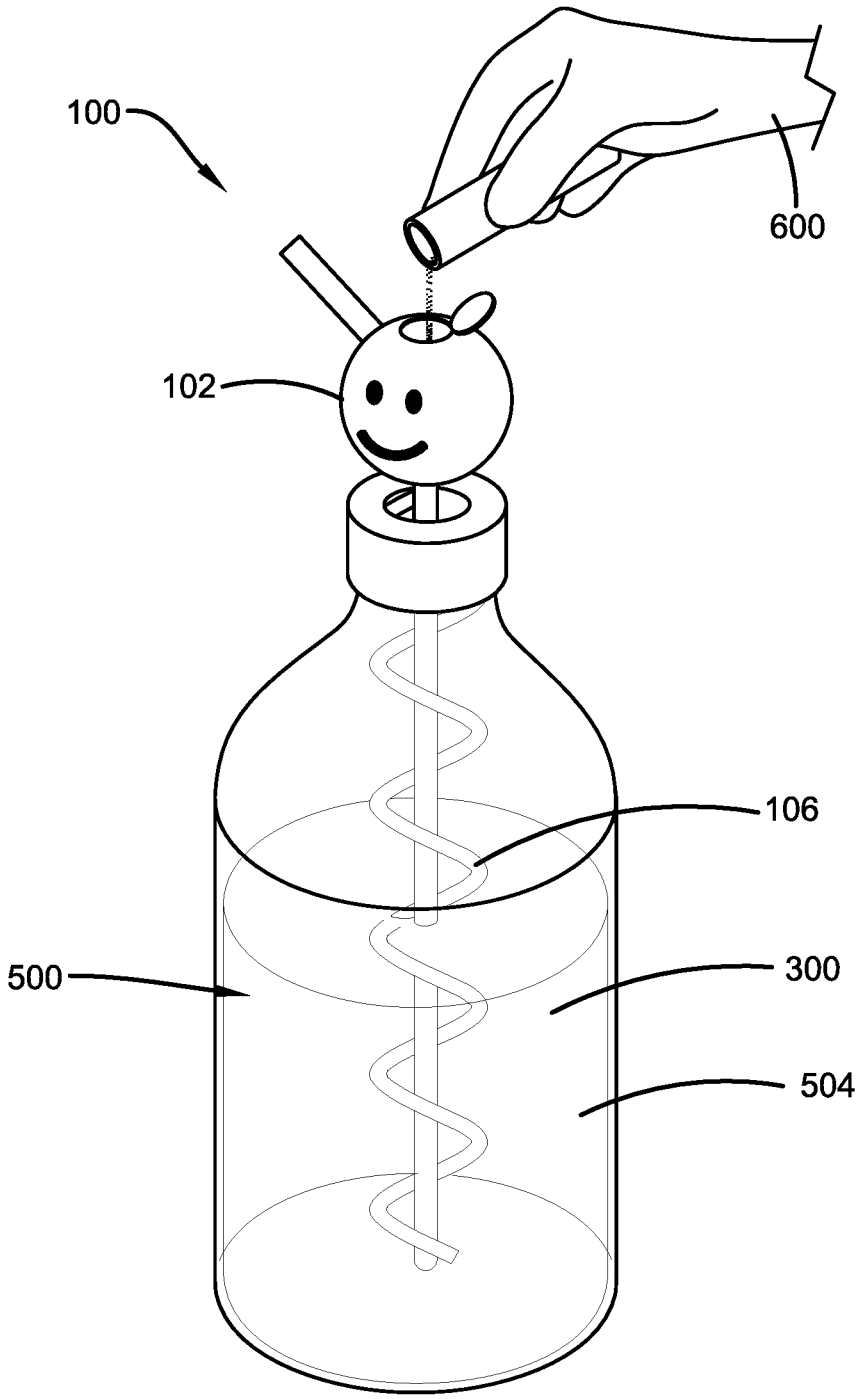
FIG. 6 illustrates a perspective view of one potential embodiment of the flavor dispensing drinking straw device of the present invention in accordance with the disclosed architecture, wherein the device is removably attached to a beverage container and a user is gently squeezing the topper to infuse the flavoring substance into the beverage contained in the beverage container.

FIG. 6 illustrates a perspective view of one potential embodiment of the flavor dispensing drinking straw device 100 of the present invention in accordance with the disclosed architecture, wherein the device 100 is removably attached to a beverage container 500 and a user 600 is gently squeezing the topper 102 to infuse the flavoring substance 300 into the beverage contained in the beverage container 500. As shown, when the topper 102 is squeezed by the hand of a user 600, the flavor/syrup/diluted medicine 300 stored in the internal cavity 1023 of the topper 102 travels through the continuous opening 1062 in the spiral straw 106 to mix with the water or other beverage 504 present in the bottle 500. The flavor/syrup/diluted medicine 300 is mixed thoroughly in the bottle 500, and can be enjoyed by the user 600 via the tubular straw 104.

Figure 7:
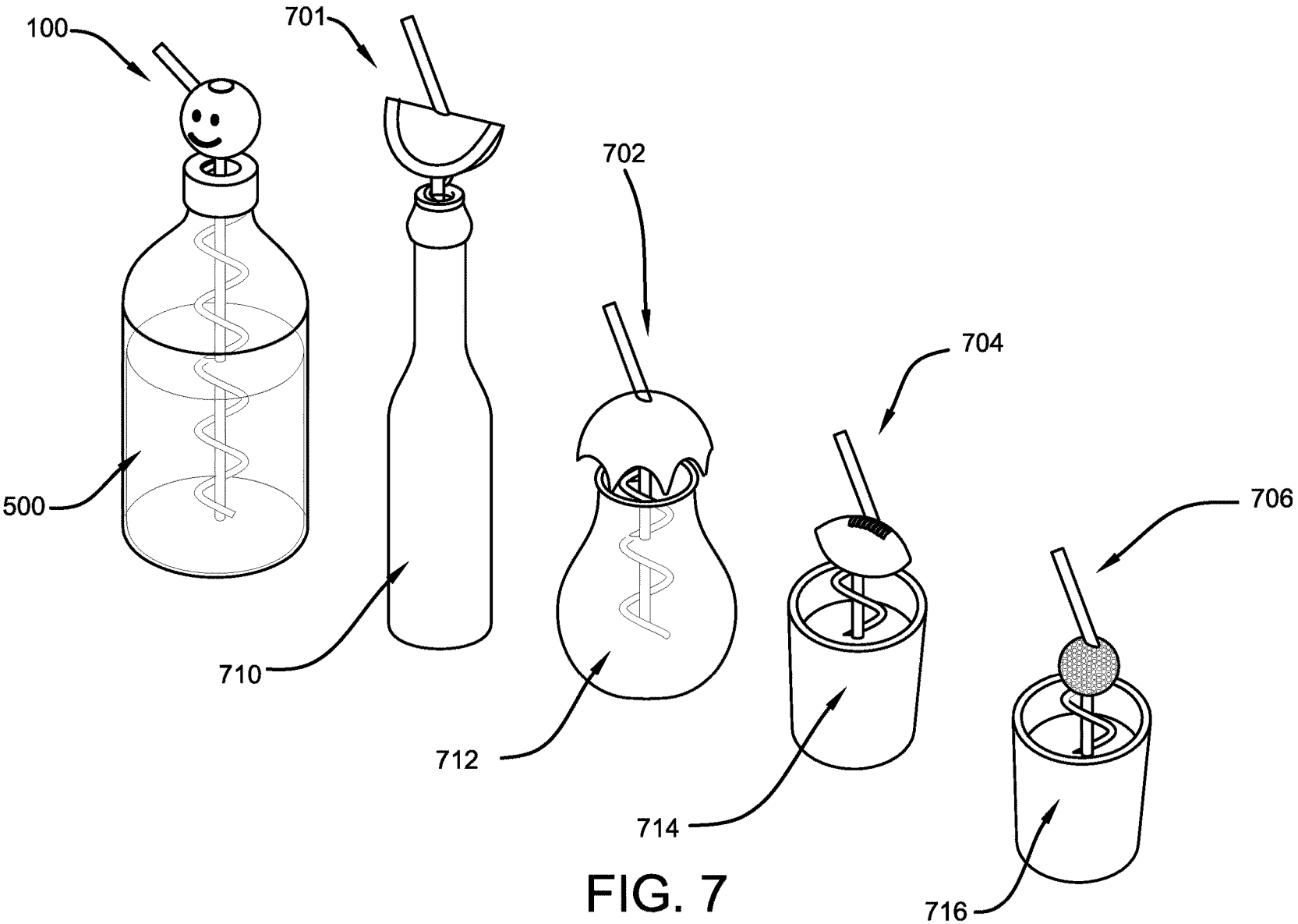
FIG. 7 illustrates a perspective view of various potential embodiments of the flavor dispensing drinking straw device of the present invention in accordance with the disclosed architecture.

FIG. 7 illustrates a perspective view of various potential embodiments of the flavor dispensing drinking straw device of the present invention in accordance with the disclosed architecture. As shown, for different types of containers or glasses, different types of flavor infused straws may be made commercially available. For example, the flavor infusing straw device 100 may be used for a bottle 500, wherein an alternative embodiment of the flavor infusing device 701 may be used in conjunction with a wine bottle 710. Similarly, a flavor infusing straw device 703 may be used for a juice bottle 712, a flavor infusing device 704 may be used in conjunction with a tumbler 714 and a flavor infusing device 706 may be used with a cup 716. Stated differently, the flavor dispensing drinking straw device of the present invention can be of various sizes and topper designs and shapes, and color, length and diameter may vary to meet requirements of different users.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "flavor/syrup dispensing straw", "silicone straw", "flavor or syrup infusing straw", "drinking straw", "flavor splash straw" and "flavor infusing straw" are interchangeable and refer to the flavor/syrup dispensing drinking straw 100 of the present invention.

Notwithstanding the forgoing, the flavor dispensing drinking straw 100 of the present invention and its various components can be of any suitable size and configuration as is known in the art without affecting the overall concept of the invention, provided that it accomplishes the above stated objectives. One of ordinary skill in the art will appreciate that the size, configuration and material of the flavor dispensing drinking straw 100 and its various components as shown in the FIGS. are for illustrative purposes only, and that many other sizes and shapes of the flavor dispensing drinking straw 100 are well within the scope of the present disclosure. Although the dimensions of the flavor dispensing drinking straw 100 are important design parameters for user convenience, the flavor dispensing drinking straw 100 and its various components may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A flavor dispensing drinking straw device comprising:
a tubular straw;
a spiral straw;
a topper having an interior cavity; and
a quantity of flavoring stored in the interior cavity; and
wherein the topper further comprises a top filling hole, a spiral straw bottom opening, and a pair of tubular straw holes for receiving the tubular straw therethrough; and
wherein the tubular straw is a drinking straw and the spiral straw is a fluid injecting straw.

2. The flavor dispensing drinking straw device as recited in claim 1, wherein each of the top filling hole and the spiral straw bottom opening are in fluid communication with the interior cavity.

3. The flavor dispensing drinking straw device as recited in claim 2, wherein the spiral straw further comprises a continuous opening therein.

4. The flavor dispensing drinking straw device as recited in claim 3, wherein the continuous opening is in fluid communication with the interior cavity via the spiral straw bottom opening.

5. The flavor dispensing drinking straw device as recited in claim 4, wherein the tubular straw further comprises a continuous channel therein.

6. The flavor dispensing drinking straw device as recited in claim 5, wherein the spiral straw further comprises a central passageway.

7. The flavor dispensing drinking straw device as recited in claim 6, wherein the tubular straw is at least partially positioned within the central passageway.

8. The flavor dispensing drinking straw device as recited in claim 6, wherein the central passageway has a length and the tubular straw is positioned within and extends the length of the central passageway.

9. The flavor dispensing drinking straw device as recited in claim 8, wherein the topper further comprises an exterior surface and at least one volumetric gradation on said exterior surface.

10. The flavor dispensing drinking straw device as recited in claim 9, wherein the tubular straw extends through the topper.

11. The flavor dispensing drinking straw device as recited in claim 10, wherein the tubular straw is not in fluid communication with the interior cavity.

12. A flavor dispensing drinking straw device comprising:
a tubular straw having a length;
a topper having an interior cavity;
a spiral straw wrapped around said tubular straw along the length, wherein the spiral straw has a continuous opening therein that is in fluid communication with the interior cavity; and
a quantity of flavoring stored in the interior cavity and capable of being dispensed through the continuous opening; and
wherein the topper further comprises a top filling hole, a spiral straw bottom opening, and a pair of tubular straw holes for receiving the tubular straw therethrough; and
wherein the topper is compressible to inject the flavoring through the spiral straw bottom opening into the spiral straw and then uncompress once released; and
wherein the tubular straw is a drinking straw and the spiral straw is a fluid injecting straw.

13. The flavor dispensing drinking straw device as recited in claim 12, wherein the tubular straw further comprises a continuous channel therein.

14. The flavor dispensing drinking straw device as recited in claim 13, wherein the topper further comprises an exterior surface and at least one volumetric gradation on said exterior surface.

15. The flavor dispensing drinking straw device as recited in claim 14, wherein the tubular straw extends through the topper.

16. The flavor dispensing drinking straw device as recited in claim 15, wherein the tubular straw is not in fluid communication with the interior cavity.

17. A flavor dispensing drinking straw device comprising:
a tubular straw;
a topper having an interior cavity;
a spiral straw wrapped around said tubular straw, wherein the spiral straw has a continuous opening therein that is in fluid communication with the interior cavity; and
a quantity of flavoring stored in the interior cavity; and
wherein the topper further comprises a top filling hole comprising a hinged lid, a spiral straw bottom opening, a pair of tubular straw holes for receiving the tubular straw therethrough, and a plurality of volumetric graduations disposed on an exterior surface of the topper; and
wherein the topper is compressible to inject the flavoring through the spiral straw bottom opening into the spiral straw and then uncompress once released; and
wherein the tubular straw is a drinking straw and the spiral straw is a fluid injecting straw.

18. The flavor dispensing drinking straw device as recited in claim 17, wherein the tubular straw passes through and extends outwardly from the topper in at least two directions.

19. The flavor dispensing drinking straw device as recited in claim 18, wherein the tubular straw is not in fluid communication with the interior cavity of the topper.

* * * * *